US005282700A

United States Patent [19]

Rodrique

[11] Patent Number: 5,282,700

[45] Date of Patent: Feb. 1, 1994

[54] BLOCK INTERLOCK OFFSETTING KEY FOR USE IN THE CONSTRUCTION OF A RETAINING WALL

[75] Inventor: Jacques Rodrique, Montreal-Nord, Canada

[73] Assignee: Transpavé Inc., Montreal-Nord, Canada

[21] Appl. No.: 37,845

[22] Filed: Mar. 29, 1993

[30] Foreign Application Priority Data

Aug. 27, 1992 [CA] Canada ..... 2092579

[51] Int. Cl.[5] ..... E02D 29/02

[52] U.S. Cl. ..... 405/284; 52/605; 52/609; 405/286

[58] Field of Search ..... 405/31, 33, 262, 273, 405/284, 285, 286; 52/582, 585, 586, 589, 590, 605-609

[56] References Cited

U.S. PATENT DOCUMENTS

| | | | |
|---|---|---|---|
| 468,838 | 2/1892 | Steiger . | |
| 1,330,884 | 2/1920 | McDermott . | |
| 1,436,551 | 11/1922 | Van Duzer . | |
| 3,422,588 | 1/1969 | Stewart | 52/605 X |
| 3,488,964 | 1/1970 | Kubo . | |
| 3,791,090 | 2/1974 | Kniefel | 52/608 X |
| 4,372,091 | 2/1983 | Brown et al. . | |
| 4,498,268 | 2/1985 | Inman | 52/606 X |
| 4,512,685 | 4/1985 | Hegle | 405/284 |
| 4,661,023 | 4/1987 | Hilfiker | 405/262 |
| 4,684,294 | 8/1987 | O'Neill | 405/286 |
| 4,884,921 | 12/1989 | Smith | 405/286 |
| 4,914,876 | 4/1990 | Forsberg | 405/286 |

FOREIGN PATENT DOCUMENTS

| | | |
|---|---|---|
| 941626 | 2/1974 | Canada . |
| 44696 | 12/1978 | Canada . |
| 1222149 | 5/1987 | Canada . |
| 71456 | 9/1992 | Canada . |
| 71457 | 9/1992 | Canada . |
| 166328 | 7/1950 | Fed. Rep. of Germany . |

*Primary Examiner*—David H. Corbin

*Attorney, Agent, or Firm*—Ronald S. Kosie; Robert Brouillette

[57] ABSTRACT

The present invention relates to a block interlock offsetting key for use in the construction of a mortarless retaining wall wherein a plurality of blocks are stacked in offset rows or courses, the blocks of the wall being provided with top and bottom grooves. The block interlock offsetting key is able to interlockingly engage the bottom groove of a block and the top groove of an underlying block so as to offset the blocks a predetermined distance with respect to each other.

12 Claims, 6 Drawing Sheets

BLOCK INTERLOCK OFFSETTING KEY FOR USE IN THE CONSTRUCTION OF A RETAINING WALL

The present invention relates to design applications Ser. No. 07/935,217 filed Aug. 27, 1992 and Ser. No. 07/935,218 field Aug. 27, 1992 and the benefit of 35 U.S.C. section 120 is claimed with respect thereto.

The present invention relates to a block interlock offsetting key for use in the construction of a mortarless retaining wall wherein a plurality of blocks are stacked in offset rows or courses, the blocks of the wall being provided with top and bottom grooves. The block interlock offsetting key is able to interlockingly engage the bottom groove of a block and the top groove of an underlying block so as to offset the blocks a predetermined distance with respect to each other.

The construction of retaining walls with pre-cast concrete blocks is well known; see for example, Canadian Industrial Design no. 44,696, Canadian patent 941,626, U.S. Pat. Nos. 468,838, 3.488,964, 4,193,718 and 4,372,091.

Thus it is known to make a retaining wall from molded (concrete) blocks wherein the blocks are weighted and shaped so as to be stackable in setback fashion so as to angle the wall to counter the pressure of landfill behind the wall. It is, for example, known to provide blocks having opposed (planar) support surfaces with an integral block interlock member(s) for interlocking and setting back successive courses of blocks; the interlock member may for example comprise a flange disposed along the rear and bottom of a retaining wall block; see, for example, U.S. Pat. Nos. 2,313,363 and 5,017,049 the entire contents of both of which are incorporated herein by reference.

It is common to use a particular set of blocks for building a wall wherein each course of blocks is set back a predetermined amount so as to provide a retaining wall having a desired inclination. However, since the interlock member is integral with the blocks, if it is desired to build a wall of different inclination (i.e. wherein the amount of the setback is different) an entirely new and different set of blocks must normally be made and used.

Also if it is desired to set a course of blocks forward relative to an underlying course of blocks, again different blocks normally must be made and used.

The result is that it is common for a manufacturer to have to keep on hand or be able to make a large number of differently shaped blocks to meet the needs of the consumer. This can lead to increased costs with respect to the blocks, e.g. storage costs, manufacturing costs, etc.

It would be advantageous to be able to exploit one type of block for use in the construction of retaining walls of different angles of inclination (i.e. wherein the block courses may be set at different amounts of setback) and wherein the same type of block may, as desired, be used in a forward or rearward offset.

STATEMENT OF INVENTION

The present invention generally relates to the use of a double grooved block for use in the construction of a mortarless retaining wall wherein a plurality of blocks are stacked in rows. The grooved block is provided with top and bottom grooves able to engage separate key members for interlocking and offsetting, (forwardly or rearwardly, as desired), the block a predetermined distance with respect to an underlying and/or overlying block as the case may be.

Thus, in accordance with a general aspect, the present invention provides a block interlock offsetting key for (i.e. suitable for) a mortarless interlocking of a pair of blocks such that one block of said pair of blocks is offset a predetermined distance with respect to the other block, each of the blocks being a grooved block, each of the grooved blocks comprising a block body, said block body having top and bottom support surfaces and a lateral front surface, said block body comprising a pair of grooves, said pair of grooves comprising a top groove interrupting said top surface and a bottom groove interrupting said bottom surface, the top and bottom grooves each being defined by a respective groove surface, said top groove at least overlapping a part of said bottom groove, said block interlock offsetting key being characterized in that said key comprises a key body, said key body comprising a root element connected to a head element, said key body having a lateral surface comprising an upper surface portion and an offset lower surface portion, said upper surface portion being offset relative to the lower surface portion, said root element defining said offset lower surface portion and said head element defining said upper surface portion, said block interlock offsetting key being configured such that the head element thereof is able to engage the bottom groove of a grooved block, and the root element thereof is able to engage the top groove of another grooved block.

In accordance with the present invention, a block interlock offsetting key is configured (to cooperate with grooved blocks) such that, when one grooved block is disposed on an underlying grooved block, the upper surface portion of the interlock key is engageable with a portion of the groove surface of the bottom groove of said one grooved block and the offset lower surface portion of the interlock key is engageable with a portion of the groove surface of the top groove of said underlying block, so that the front surface of said one grooved block is offset a predetermined distance with respect to the front surface of said underlying block.

An offsetting key herein may take any form whatsoever keeping in mind its purpose which is to be able not only to interlock two blocks together but also to adjust the degree of offset of one block with respect to another.

The key may have one lateral surface provided with the offset surface portions. Alternatively, if desired the interlock key may comprise a key body having an opposed pair of lateral surfaces, each said lateral surface comprising a said upper surface portion and a said offset lower surface portion, and said head element defining both of said upper portions and said root element defining both of said lower surface portions.

An upper surface portion of a key may be offset inwardly or outwardly with respect to the lower surface portion. If a key has two opposed lateral side surfaces, each of which includes respective upper and lower surface portions, both upper surface portions may be inwardly or outwardly offset with respect to the lower surface portions or one upper surface portion may be inwardly offset while the other upper surface portion is outwardly offset with respect to their respective lower surface portions.

In accordance with the present invention, a block interlock key may be configured to cooperate with a respective pair of grooved blocks such that one grooved block may be offset, rearwardly or forwardly, a predetermined distance with respect to an underlying block. For example, a key may be configured such that if an upper block is in a rearwardly offset position, by reversing the disposition of the key in the grooves the overlying block may be made to be offset forwardly instead.

In accordance with the present invention, the same blocks may be advantageously used with one basic key shape type, to construct retaining walls of different inclination. Thus, a family of keys of similar sub-shapes may be derivable from the basic key type, each key of the family providing a particular offset distance between blocks. For any particular configuration of top and bottom grooves for a block(s), the basic shape and size of the head and root portion of a key may, for example, be maintained but the offset distance between the upper and lower surfaces of the key may be varied in order to achieve a different offset setting for the same block shape (i.e. blocks having the same shaped top and bottom grooves).

A block in accordance with the present invention may have one or more of the groove pairs; each pair comprising said top and bottom grooves. If more than one pair of grooves is present the pairs are of course suitably spaced apart.

In accordance with another aspect, the present invention provides, a kit for use in the construction of a mortarless retaining wall wherein a plurality of blocks are stacked in a number of successive offset courses of blocks, the kit comprising a plurality of grooved blocks and a plurality of block interlock offsetting keys, each of the grooved blocks comprising a block body, said block body having top and bottom support surfaces and a lateral front surface, said block body comprising a pair of grooves, said pair of grooves comprising a top groove interrupting said top surface and a bottom groove interrupting said bottom surface, the top and bottom grooves each being defined by a respective groove surface, said top groove at least overlapping a part of said bottom groove, each block interlock offsetting key comprising a key body, said key body comprising a root element connected to a head element, said key body having a lateral surface comprising an upper surface portion and an offset lower surface portion, said upper surface portion being offset relative to said lower surface portion, said root element defining said offset lower surface portion and said head element defining said upper surface portion, each block interlock offsetting key being configured such that the head element thereof is able to engage the bottom groove of a grooved block, and the root element thereof is able to engage the top groove of another grooved block, and said block interlock offsetting keys and said grooved blocks being configured such that, when one grooved block is disposed on an underlying grooved block, said upper surface portion of a respective interlock key is engageable with a portion of the groove surface of the bottom groove of said one grooved block and said offset lower surface portion of said respective interlock key is engageable with a portion of the groove surface of the top groove of said underlying block, so that the front surface of said one grooved block is offset a predetermined distance with respect to the front surface of said underlying block.

The top and bottom grooves of a pair of grooves of a block may be disposed anywhere on a respective top and bottom surface. The top groove is to, however, at least overlap a part of the bottom groove, i.e. at least a part of the top groove is disposed above a part of the bottom groove. The top groove may, in particular overly at least part of the bottom groove. If the top groove overlaps the bottom groove a part of the top groove is not disposed above the bottom groove but to one side thereof; and a part of the bottom groove is not disposed beneath the top groove but to one side thereof. On the other hand, if the top groove overlies the bottom groove, it is to be understood that either all of the top groove overlies at least a part of the bottom groove or the bottom groove is disposed entirely beneath the top groove, i.e. the bottom groove is the same size or smaller than the top groove. The top groove may be the same size or be larger or smaller than the bottom groove. In accordance with a preferred aspect, the top and bottom grooves of a block may be at least substantially the same (i.e. the same or substantially the same ) distance from the front surface thereof.

The top grooves of the blocks (of a kit) may be identically shaped; similarly, the bottom grooves of the blocks may be identically shaped. Each block (of a kit) may comprises a rectangular block body including a lateral rear surface and a pair of opposed end side surfaces; the top grooves may be open-ended grooves which extend from one said side surface thereof to the other said side surface thereof.

With respect to a kit in accordance with the present invention, the number of blocks and associated keys will of course depend on many variables such as the height and front surface area of the desired retaining wall, the size of the blocks, the size of the keys, whether one key is to be used to offset one or more upper blocks with respect to one or more underlying blocks, whether two or more keys are to be used to offset one upper block with respect to one underlying block, etc.. Thus, for example, one key may be sized such that it extends through the channels of two or more blocks in the same row thereof; alternatively, depending on the size of the keys and grooves, a plurality of keys may be used to offset one block with respect to an underlying block; furthermore one key could of course be used for every stacked pair of blocks.

The blocks and keys of the present invention may be made in any (known) manner, e.g. by forming a suitable mold and pre-casting the block or key body as concrete bodies or as bodies of any other material suitable for forming blocks for the construction of a mortarless retaining wall. The blocks may be solid and may if desired include any necessary openings. The keys may be solid or also include openings for the insertion of pins therethrough for engaging holes in the wall of the grooves so as to stabilize the key therein.

It is to be understood herein, that if a "range", "group" or other class type word is used or is mentioned with respect to a particular characteristic of the present invention, the present invention relates to and explicitly incorporates herein each and every specific member and combination of sub-ranges, sub-groups, etc., therein whatsoever. Thus, any specified range, group or class is to be understood as a shorthand way of referring to each and every member of a range, group or class individually as well as each and every possible sub-ranges, sub-groups, etc. encompassed therein.

In drawings which illustrate example embodiments of the present invention:

Figure 1:
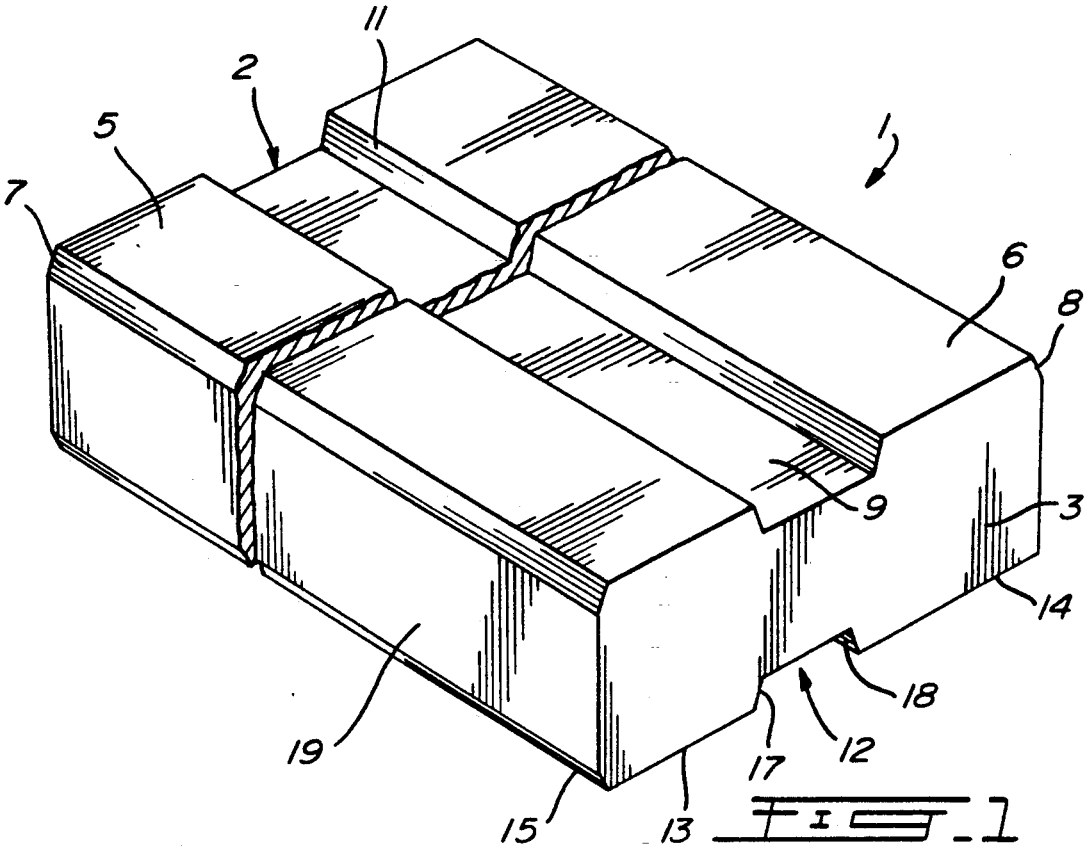
FIG. 1 is a top perspective view of an example embodiment of a construction block in accordance with the present invention, broken to show relative longer length than width.

FIGS. 1 to 7 illustrate an embodiment of a grooved block in accordance with the present invention. The illustrated grooved block comprises a block body 1. The block body 1 has an elongated generally rectangular aspect.

The block body 1 has a top (planar) support surface which is interrupted by a more or less centrally disposed top groove 2. The top groove 2 is open-ended and extends from the lateral end side surface 3 to the lateral end side surface 4. The top groove 2 thus divides the (planar) top surface into a front top surface portion 5 and a rear top surface portion 6. The front top surface portion 5 includes a bevelled end part 7 while the rear top portion 6 includes a bevelled end part 8.

The top groove 2 is defined by a groove surface which comprises a (planar) bottom surface 9 and two sloped (planar) opposed side surfaces 10 and 11. The sloped surface 10 may be considered to be a front groove surface portion since it intersects the front top surface portion 5; on the other hand the sloped surface portion 11 may be considered to be a rear groove surface portion since it intersects the rear top surfaced portion 6.

The block body 1 also has a bottom (planar) support surface which is interrupted by a more or less centrally disposed bottom groove 12. The bottom groove 12 is open-ended and extends from the lateral end side surface 3 to the lateral end side surface 4. The bottom groove 12 thus divides the (planar) bottom surface into a front bottom surface portion 13 and a rear bottom surface portion 14. The front bottom surface portion 13 includes a bevelled end part 15.

The bottom groove 2 is defined by a groove surface which comprises a (planar) bottom surface 16 and two sloped (planar) opposed side surfaces 17 and 18. The sloped surface 17 may be considered to be a front groove surface portion since it intersects the front bottom surface portion 13; on the other hand the sloped surface portion 18 may be considered to be a rear groove surface portion since it intersects the rear bottom surface portion 14.

The block body 1 also has a lateral front surface 19 and a lateral rear surface 20.

In FIGS. 1 to 7 the grooves 2 and 12 are shown as being open-ended. The grooves 2 and 12 need not however extend across the entire respective top or bottom surface. Alternatively, if desired, for example, one or both of the ends of the grooves 2 (and 12) could be closed off by end members such that the top (and bottom) surface adjacent each side end surface could include a top (and bottom) surface (bridge) portion(s) connecting the front and rear top (and bottom) surface portions together. In such case, the key would of course have to be sized accordingly, i.e. be sized to fit between the groove end members. A bridge member could also be disposed intermediate the (open) ends of the groove(s).

The cross-section of the grooves may be the same or different. As shown in FIGS. 1 to 7, the cross-section of the grooves are each more or less of the same shape; the groove 12 is, however, not as wide as the groove 2. The cross-sectional aspect of the grooves may of course be different, i.e. instead of being U-shaped, one or both of the grooves could be V-shaped in cross-section, semicircular in cross-section, etc. . .

Although the grooves 2 and 12 are shown as being centrally disposed, they could of course be displaced so as to be closer to the front surface 19 or the rear surface 20, i.e. while keeping the same general shape and overlying alignment relative to each other.

As mentioned above, the top groove and the bottom groove may be disposed anywhere on the respective top or bottom surface. The top groove is aligned with respect to the bottom groove such that it may at least overlap a part of the bottom groove; and in particular such that it overlies all of the bottom groove. The top groove may for example overlap (a part of) the bottom groove. If for example, the top groove is (horizontally) offset to overlap the bottom groove, the offset between the upper portion and the lower portion of the key (as discussed below) will have to be more radically adjusted to effect a particular offset setting then if the grooves were in an overlying relation. The preferred alignment of the top groove with respect to the bottom groove has the top groove overlying the bottom groove either wholly or in part; the bottom groove may be wider, for example, than the top groove.

Figure 2:
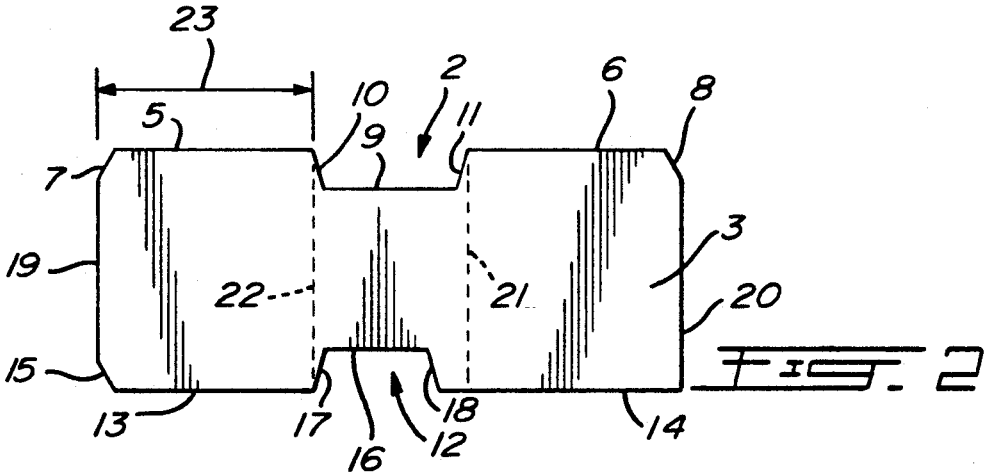
FIGS. 2 and 3 are end elevations of the block of FIG. 1.
Figure 3:
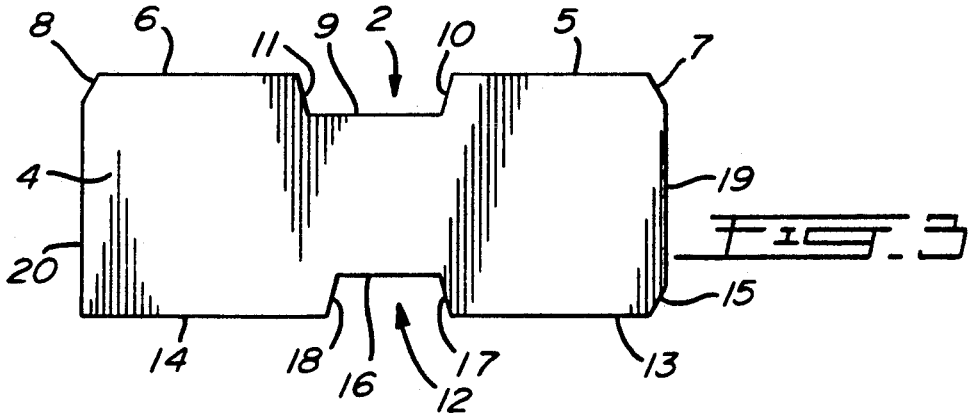
Figure 5:
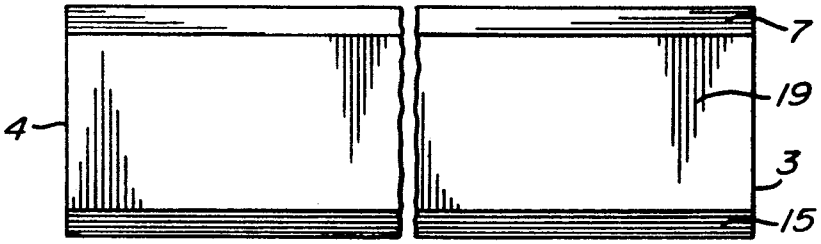
FIGS. 4 and 5 are, respectively, rear and front plan views of the block of FIG. 1, broken to show relative longer length than width.
Figure 7:
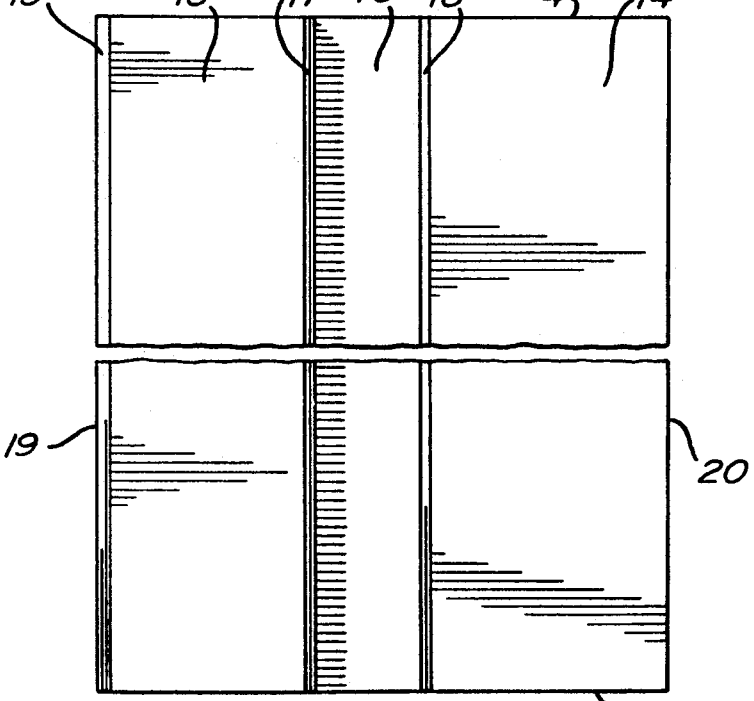
FIGS. 6 and 7 are, respectively, top and bottom plan views of the block of FIG. 1, broken to show relative longer length than width.
Figure 4:
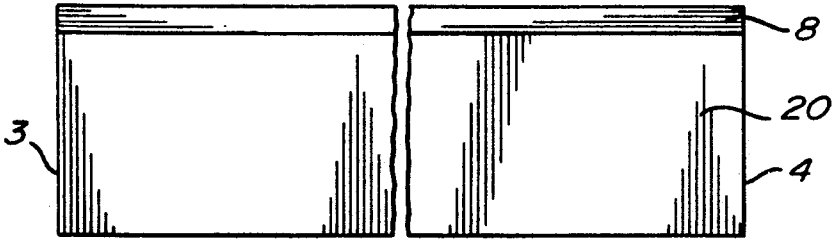
Figure 6:
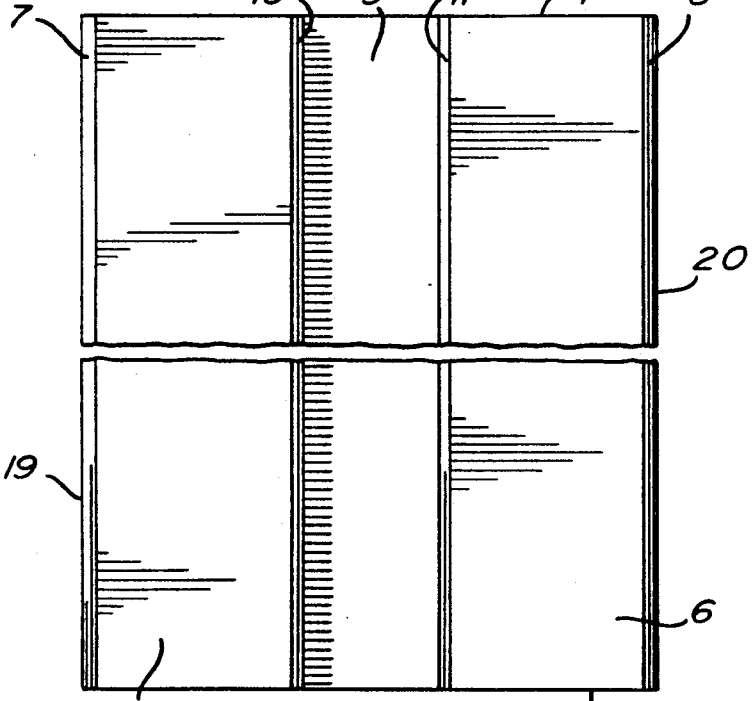
Figure 8:
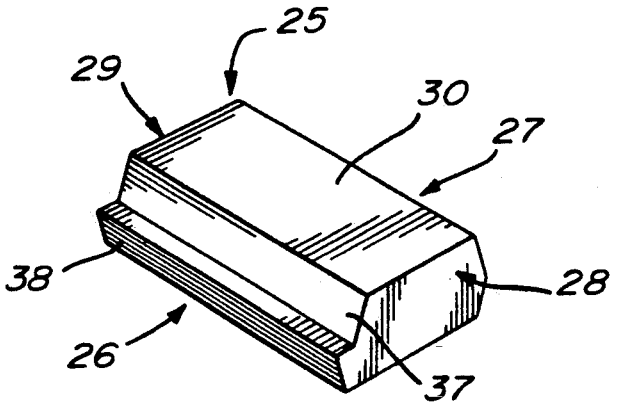
FIG. 8 is a top perspective view of an embodiment of an interlock offsetting key of the present invention engageble with the top and bottom grooves of the block of FIG. 1.
Figure 9:
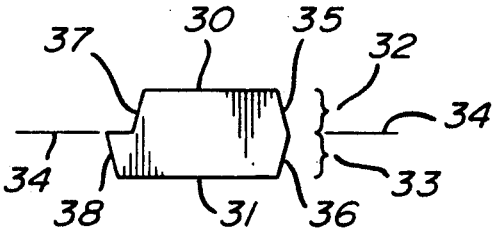
FIGS. 9 and 10 are end elevations of the key of FIG. 8.
Figure 10:
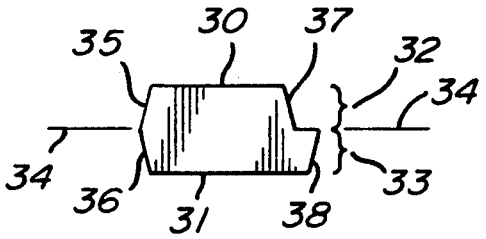
Figure 11:
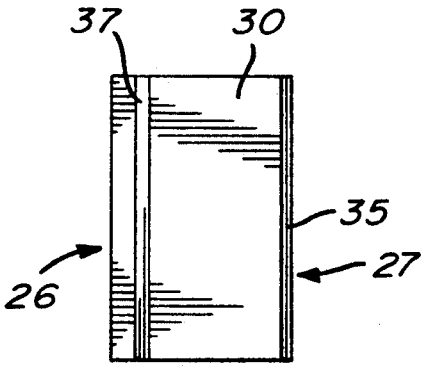
FIGS. 11 and 12 are, respectively, top and bottom plan views of the key of FIG. 8.
Figure 12:
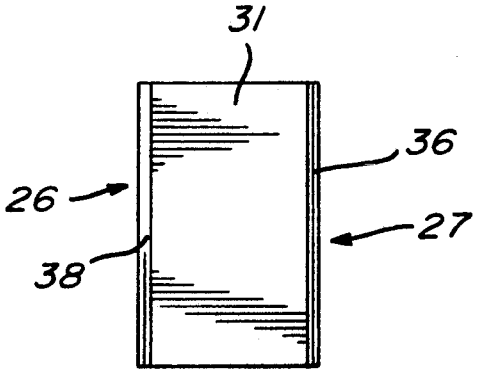
Figure 13:
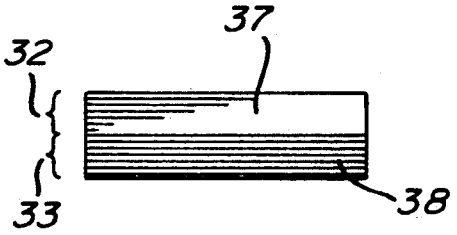
FIGS. 13 and 14 are, respectively, front and rear plan views of the key of FIG. 8.
Figure 14:
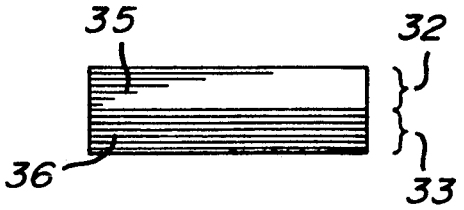

Thus, referring to FIG. 2, the top groove 2 entirely overlies the bottom groove 12. This is illustrated by the dotted lines 21 and 22 which represent vertical planes which pass through the lines of intersection of the top front and top rear surface portions 5 and 6 and the groove surface portions 10 and 11. The planes 21 and 22 are perpendicular to the plane of the sheet of paper on which the FIG. 2 is disposed i.e. the planes are viewed edge on. As may be seen the bottom groove 12 lies entirely between the planes 21 and 22. The plane 22 also passes through the intersection of the bottom front surface portion 13 and the groove surface portion 17.

Thus, the grooves 2 and 12 are shown as being the same distance from the front surface 19; this distance is shown by the arrow designated 23.

The top and bottom surfaces may be planar, roughened and the like provided that they can achieve their support function.

Referring to FIGS. 8 to 15, these show an example embodiment of a block interlock offsetting key for use with blocks having the shape illustrated in FIGS. 1 to 7. The illustrated key comprises a key body 25. The key body 25 has two opposed lateral sides (or surfaces) indicated generally by the reference numbers 26 and 27, two opposed (planar) end side surfaces 28 and 29 as well as opposed (planar) top and bottom surfaces 30 and 31.

The key body 25 comprises an upper head element 32 and a lower root element 33. The head element 32 is integral with the root element 33 and they may (referring to FIGS. 9, 10 and 15) be considered as being connected together along an interfaoe defined by a median plane 34 which is perpendicular to the plane of the paper on which the FIGS. appear. The lateral side surface 27 has an upper (planar) surface portion 35 and a lower (planar) surface portion 36; surface portion 35 is defined by the head element 32 and the surface portion 36 is defined by the root portion 33.

Figure 15:
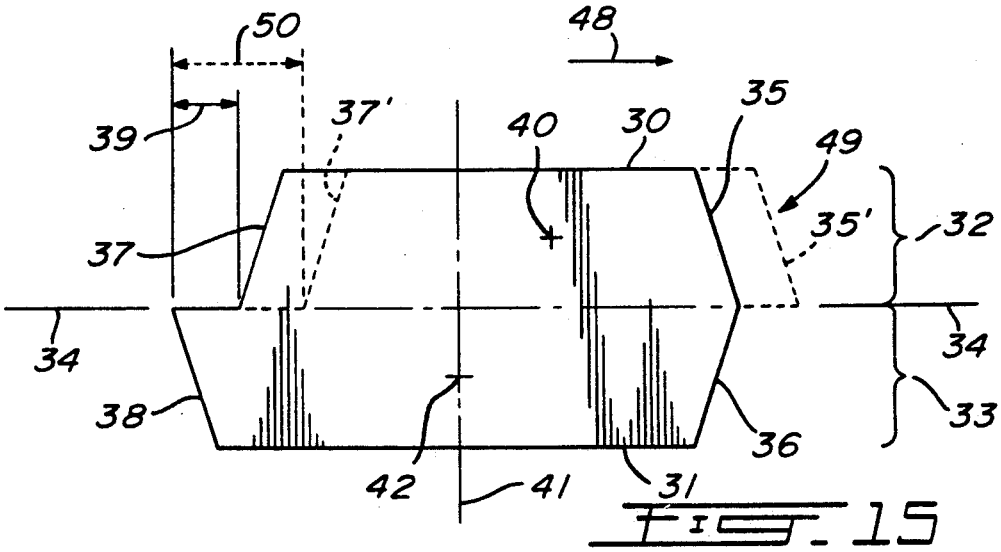
FIG. 15 is an enlarged view of FIG. 9.

The key body also has a unitary lip projecting outwardly on the lateral side 26. The lip is integral with and forms part of the root portion 33. Due to the presence of the lower lip, the lateral side surface 26 comprises an upper surface portion 37 and a lower offset surface portion 38. Turning to FIG. 15 (which is an enlarged copy of FIG. 9), the upper surface portion 37 is (horizontally) offset (inwardly) relative to lower surface portion 38 by an amount indicated generally by the arrow 39.

The key of FIGS. 8 to 15 may be considered as having an asymmetric key body in the sense that the longitudinal median axis 40 of the head portion 32 is offset to one side of the vertical plane 41 passing through the longitudinal axis 42 of the root portion 33; the plane 41 is, as in the case of the other mentioned planes, perpendicular to the plane of the paper and is viewed on edge. The longitudinal median axii pass through the length of the elements of the key body.

Figure 25:
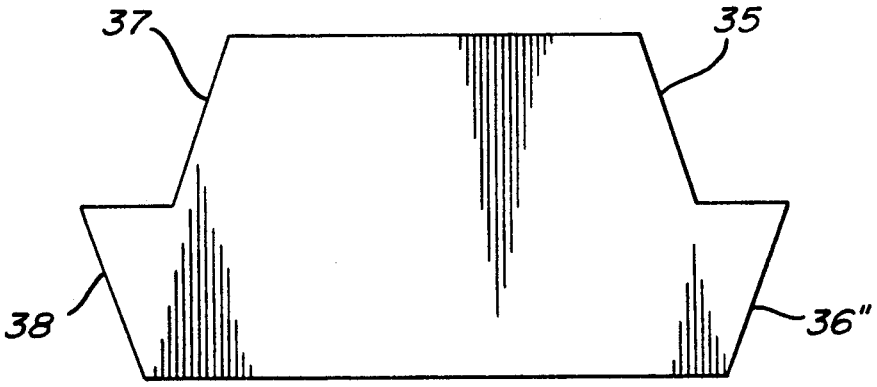
FIG. 25 is an end elevation of another embodiment of a key in accordance with the present invention.

A key based on the key of FIGS. 8 to 15 may be modified to be symmetric i.e. wherein the longitudinal median axii may both lie in the same vertical plane. For example the lateral side 27 may be modified to include a lower lip the same as the lower lip on the lateral side 26; see FIG. 25 wherein the same reference numbers are used to designate the common surfaces, reference number 36" designating the outwardly displaced lower surface portion of side 27. In this case the upper surface portion 35 is offset (inwardly towards the surface 37) relative to the lower surface portion 36". The top groove 2 of the block shown in FIGS. 1 to 7 would of course have to be widened to accommodate the enlarged root portion 33 for such a symmetric key.

Figure 16:
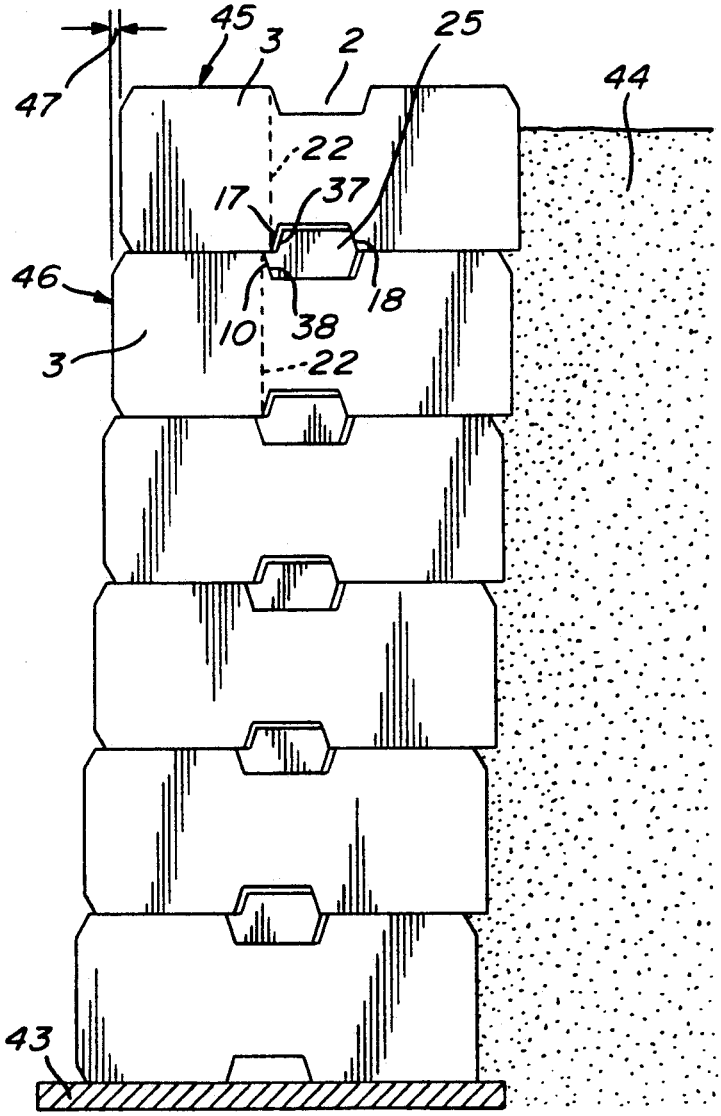
FIG. 16 is a side elevation of a portion of a retaining wall made with a plurality of wall blocks of FIG. 1 and a plurality of keys of FIG. 8.

Turning to FIG. 16, this figure shows in side view a stack of blocks as shown FIGS. 1 to 7, the blocks being interlocked and offset by a plurality of keys shown in FIGS. 8 to 15. Accordingly, the same reference numerals will be used to identify the same elements, surfaces, parts, etc. . . The stack forms part of a retaining wall which is inclined rearwardly, i.e. an upper block is offset rearwardly with respect to an immediately underlying block. The stack is supported on a suitable support 43 and is inclined against an earth (fill) 44.

The stack will be discussed with respect to the two uppermost blocks 45 and 46; the comments apply equally to the other underlying block pairs.

The block 45 is offset rearwardly with respect to the block 46, an amount indicated generally by the arrow 47. The key body 25 is sized to engage the adjacent grooves 2 and 12 of blocks 46 and 45 respectively. The key body 25 may have a longitudinal length equal to or less than the entire length of the grooves 2 and 12. In the case where an upper block overlaps two lower blocks the key may have a length such that it is partly in the grooves 12 of both of the underlying blocks.

As shown in FIG. 16, the upper surface 37 of the key is able to engage the groove surface portion 17 of the bottom groove 12 of the block 45. On the other hand, the offset lower surface portion 38 is able to engage the groove surface portion 2 of the top groove 10 of the block 46. With the key interlocking the blocks 45 and 46 as shown, the planes 22 of these blocks are not able to be in line, i.e. the planes 22 are offset, with the plane 22 of block 45 being disposed rearwardly.

If it is desired to increase the degree of offset for a stack as shown in FIG. 16 while using the same blocks, the key(s) may, as shown in FIG. 15, be modified by displacing the head portion 32 in the direction of the arrow 48; the new disposition of the head portion 32 being denoted by the dotted outline. The modified key will have a new upper surface portion 37' and a new surface portion 35'. The modified key will also have an overhanging lip indicated generally by the reference numeral 49. The degree of (horizontal) offset of the upper surface 37' with respect to the lower surface 38 is represented by the arrow designated 50. Apart from these differences the modified head portion and the root portion are the same size as the old head portion and root portion and so will be engageable in respective top and bottom grooves 12 and 2 of a pair of stacked adjacent blocks of FIGS. 1 to 7. As may be appreciated, if such a modified key is used for the stack shown in FIG. 16, the displacement of the head portion to the right as shown in the FIG. 15 will mean that the plane 22 of the block 45 will likewise be displaced further to the rear and so increase the offset of the block 45 relative to the block 46; and so on if the modified key is used throughout the wall structure. In FIG. 16 the upper surface 37' of the modified key will engage the groove surface portion 17 of the bottom groove 12 of the block 45 whereas the surface portion 35' will engage the surface portion 18 of the same groove 12. On the other hand, if the position of the modified key in the grooves is reversed the block 45 may be offset forwardly a similar amount rather than rearwardly; i.e. the surface 37' would engage the surface portion 18 and the surface portion 35' would engage the surface portion 17 of the groove 12 of the block 45.

FIGS. 17 to 24 illustrate other example embodiments for the key; the use of these further keys may require corresponding changes to the grooves of the block so as to accommodate the differently configured head and root portions.

Figure 20:
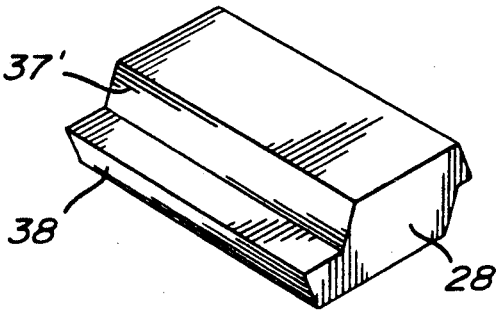
FIG. 20 is a top perspective view of a further embodiment of an interlock offsetting key of the present invention.
Figure 21:
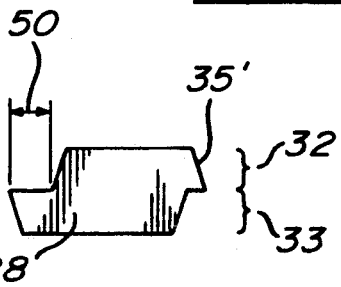
FIGS. 21 and 22 are end elevations of the key of FIG. 20.
Figure 22:
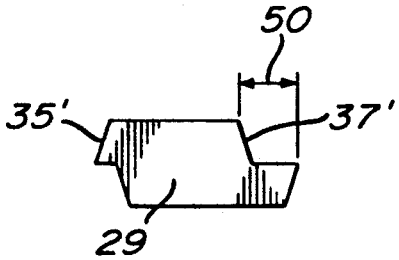

FIGS. 20 to 22 reflect the modified key as discussed above with respect to the FIG. 15, the same reference numerals being used.

Figure 17:
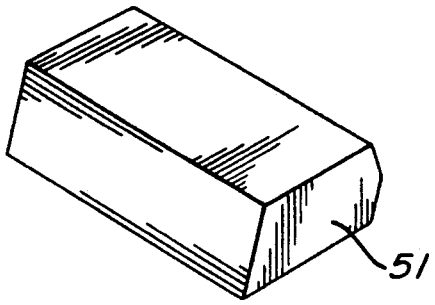
FIG. 17 is a top perspective view of another embodiment of an interlock offsetting key of the present invention.
Figure 18:
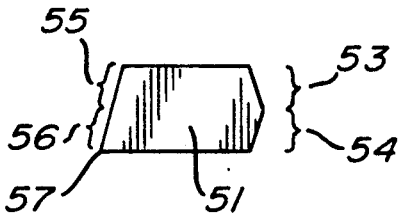
FIGS. 18 and 19 are end elevations of the key of FIG. 17.
Figure 19:
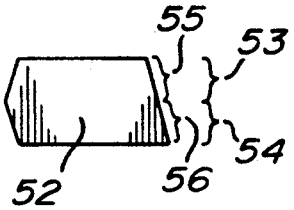

FIGS. 17 to 18 reflect a version of the key shown in FIGS. 1 to 7 but wherein the lower lip on the lateral side surface 26 is not present. The key still has head portion 53 and a root portion 54. The upper surface portion is designated 55 and merges seamlessly into the lower surface portion 56. The apex 57 would for example abut the intersection of the surfaces 9 and 10 of the top groove of a block shown in FIGS. 1 to 7. If the key of FIGS. 17 to 18 were used in the stack shown in FIG. 16 the upper surface 55 would engage the surface 17 of the bottom groove 12 of block 45. On the other hand, the lower surface 54 of the key would essentially be spaced apart from the surface portion 10 of the top groove 2 of the block 46.

Figure 23:
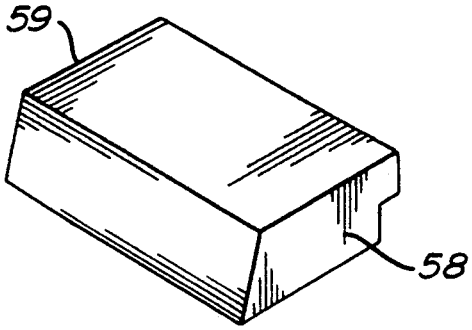
FIG. 23 is a top perspective view of an additional embodiment of an interlock offsetting key of the present invention engageable with the top and bottom grooves of the block of FIG. 1.
Figure 24:
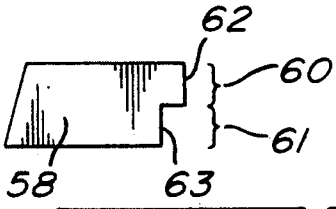
FIG. 24 is an end elevation of the key of FIG. 23.

FIGS. 23 and 24 show another example key having end surfaces 58 and 59. The key shown has head portion 60 and root portion 61. The head portion 60 has an upper (squarish) lip providing an upper surface portion 62 offset (outwardly) relative to the lower surface portion 63. This key may be used with a block(s) having appropriately modified grooves to forwardly offset an upper block relative to an underlying block, the grooves being disposed such that they are the same or substantially same distance from the front surface of the block.

While specific embodiments of this invention have been illustrated in the accompanying drawings and described hereinabove, it will be evident to those skilled in the art that changes and modifications may be made therein without departing from the essence of this invention, as set forth in the appended claims.

The embodiments of the invention in which an exclusive property or privilege is claimed are defined as follows:

1. A kit for use in the construction of a mortarless retaining wall wherein a plurality of blocks are stacked in a number of successive offset courses of blocks, the kit comprising a plurality of grooved blocks and a plurality of block interlock offsetting keys, each of the grooved blocks comprising a block body, said block body having top and bottom support surfaces and a lateral front surface, said block body comprising a pair of grooves, said pair of grooves comprising a top groove interrupting said top surface and a bottom groove interrupting said bottom surface, the top and bottom grooves each being defined by a respective groove surface, said top groove at least overlapping a part of said bottom groove, each block interlock offsetting key comprising a key body, said key body comprising a root element connected to a head element, said key body having a lateral surface comprising an upper surface portion and an offset lower surface portion, said upper surface portion being offset relative to said lower surface portion, said root element defining said offset lower surface portion and said head element defining said upper surface portion, each block interlock offsetting key being configured such that the head element thereof is able to engage the bottom groove of a grooved block, and the root element thereof is able to engage the top groove of another grooved block, and said block interlock offsetting keys and said grooved blocks being configured such that, when one grooved block is disposed on an underlying grooved block, said upper surface portion of a respective interlock key is engageable with a portion of the groove surface of the bottom groove of said one grooved block and said offset lower surface portion of said respective interlock key is engageable with a portion of the groove surface of the top groove of said underlying block, so that the front surface of said one grooved block is offset a predetermined distance with respect to the front surface of said underlying block.

2. A kit as defined in claim 1 wherein, for each block, the top groove overlies at least part of the bottom groove.

3. A kit as defined in claim 1 wherein, for each block, the bottom groove is entirely beneath the top groove.

4. A kit as defined in claim 1 wherein, for each block, said top and bottom grooves are at least substantially the same distance from the front surface thereof.

5. A kit as defined in claim 4 wherein, for each block, the bottom groove is entirely beneath the top groove.

6. A kit as defined in claim 1 wherein the top grooves of the blocks are identically shaped, wherein the bottom grooves of the blocks are identically shaped, wherein each block comprises a rectangular block body including a lateral rear surface and a pair of opposed end side surfaces, wherein, for each block, said top and bottom grooves are each an open-ended groove extending from one said side surface thereof to the other said side surface thereof and wherein, for each block, said top and bottom grooves are at least substantially the same distance from the front surface thereof.

7. A kit as defined in claim 6 wherein, for each block, the bottom groove is entirely beneath the top groove.

8. A kit as defined in claim 2 wherein each interlock key comprises a key body having an opposed pair of lateral surfaces, each said lateral surface comprising a said upper surface portion and a said offset lower surface portion, and said head element defining both of said upper portions and said root element defining both of said lower surface portions.

9. A kit as defined in claim 8 wherein the top grooves of the blocks are identically shaped, wherein the bottom grooves of the blocks are identically shaped, wherein each block comprises a rectangular block body including a rear surface and a pair of opposed end side surfaces, wherein, for each block, said top and bottom grooves are each an open-ended groove extending from one said side surface thereof to the other said side surface thereof and wherein, for each block, said top and bottom grooves are at least substantially the same distance from the front surface thereof.

10. A kit as defined in claim 9 wherein, for each block, the bottom groove is entirely beneath the top groove.

11. A block interlock offsetting key for a mortarless interlocking of a pair of blocks such that one block of said pair of blocks is offset a predetermined distance with respect to the other block, each of the blocks being a grooved block, each of the grooved blocks comprising a block body, said block body having top and bottom support surfaces and a lateral front surface, said block body comprising a pair of grooves, said pair of grooves comprising a top groove interrupting said top surface and a bottom groove interrupting said bottom surface, the top and bottom grooves each being defined by a respective groove surface, said top groove at least overlapping a part of said bottom groove, said block interlock offsetting key being characterized in that said key comprises a key body, said key body comprising a root element connected to a head element, said key body having a lateral surface comprising an upper surface portion and an offset lower surface portion, said upper surface portion being offset relative to the lower surface portion, said root element defining said offset lower surface portion and said head element defining said upper surface portion, said block interlock offsetting key being configured such that the head element thereof is able to engage the bottom groove of a grooved block, and the root element thereof is able to engage the top groove of another grooved block.

12. A key as defined in claim 11 wherein said interlock key comprises a key body having an opposed pair of lateral surfaces, each said lateral surface comprising a said upper surface portion and a said offset lower surface portion, and said head element defining both of said upper portions and said root element defining both of said lower surface portions.

* * * * *

UNITED STATES PATENT AND TRADEMARK OFFICE

CERTIFICATE OF CORRECTION

PATENT NO. : 5,282,700

DATED : February 1, 1994

INVENTOR(S) : Jacques Rodrigue

It is certified that error appears in the above-identified patent and that said Letters Patent is hereby corrected as shown below:

On the title page, item [75]

Change "Rodrique" to "Rodrigue"

Signed and Sealed this

Seventeenth Day of December, 1996

*Attest:*

BRUCE LEHMAN

*Attesting Officer*

*Commissioner of Patents and Trademarks*